US007537473B2

(12) United States Patent
Johannes

(10) Patent No.: US 7,537,473 B2
(45) Date of Patent: May 26, 2009

(54) LOW PROFILE SHORTING BAR FOR ELECTRICAL CONNECTOR

(75) Inventor: Richard A. Johannes, Lake Orion, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/824,200

(22) Filed: Jun. 28, 2007

(65) Prior Publication Data

US 2009/0004900 A1 Jan. 1, 2009

(51) Int. Cl.
*H01R 29/00* (2006.01)

(52) U.S. Cl. ..... 439/188

(58) Field of Classification Search ..... 439/188, 439/352, 510; 200/51.1
See application file for complete search history.

(56) References Cited

U.S. PATENT DOCUMENTS

| | | | | |
|---|---|---|---|---|
| 4,152,041 | A | 5/1979 | Hollyday et al. | 339/147 P |
| 4,170,939 | A | 10/1979 | Hoheisel et al. | 102/28 S |
| 5,112,238 | A | 5/1992 | Cizin | 439/188 |
| 5,401,180 | A | 3/1995 | Muzslay | 439/188 |
| 5,588,855 | A * | 12/1996 | Nankoh | 439/188 |
| 5,653,606 | A | 8/1997 | Chrysostomou | 439/352 |
| 5,697,501 | A * | 12/1997 | Johansen | 206/719 |
| 6,203,342 | B1 | 3/2001 | Gauker et al. | 439/188 |
| 6,234,814 | B1 | 5/2001 | Hirschmann | 439/188 |
| 6,257,922 | B1 * | 7/2001 | Shinozaki | 439/489 |
| 6,276,953 | B1 | 8/2001 | Gauker et al. | 439/352 |
| 6,544,060 | B2 * | 4/2003 | Wakui et al. | 439/188 |
| 6,726,495 | B2 * | 4/2004 | Hirschmann | 439/188 |
| 6,893,277 | B2 | 5/2005 | Parrish et al. | 439/188 |
| 6,899,556 | B2 | 5/2005 | Nishida et al. | 439/188 |

FOREIGN PATENT DOCUMENTS

| | | | |
|---|---|---|---|
| JP | 2002-075547 A | * | 3/2002 |
| JP | 2002-305057 A | * | 10/2002 |

* cited by examiner

*Primary Examiner*—Hae Moon Hyeon
(74) *Attorney, Agent, or Firm*—Harrington & Smith, PC

(57) ABSTRACT

Disclosed herein is an electrical connector. The electrical connector includes a housing, at least two male contacts, and a shorting member. The at least two male contacts are mounted within the housing. The shorting member is connected to the housing. The shorting member includes a single loop section and an aperture. The single loop section is adapted to contact the at least two male contacts when the electrical connector is disengaged from a mating electrical connector. The single loop section is adapted to be spaced from the at least two male contacts when the electrical connector is engaged with the mating electrical connector. The at least two male contacts extend through the aperture.

19 Claims, 4 Drawing Sheets

LOW PROFILE SHORTING BAR FOR ELECTRICAL CONNECTOR

BACKGROUND OF THE INVENTION

1. Field of the Invention

The invention relates to an electrical connector and, more particularly, to a shorting bar for an electrical connector.

2. Brief Description of Prior Developments

Electrical connectors having shorting members are well known in the art. U.S. Pat. Nos. 6,276,953 and 6,234,814 disclose electrical connectors having various shorting member configurations. The shorting members are configured to contact male electrical contacts of the electrical connector until the connector is mated with a female electrical connector. Electrical connectors having shorting members may be used in various applications, such as automobile air bag safety systems for example. The shorting members help prevent the air bag system from inadvertent actuation when the mating electrical connectors are disconnected from each other.

The use of air bags in automobiles has significantly increased in recent years. Additionally, more and more automobiles have multiple air bag safety systems. Accordingly, there is a need to provide improved connectors comprising shorting members having a robust configuration and increased reliability. Also, these electrical connectors are becoming increasingly small. Therefore, there is a need to provide an electrical connector having a shorting member, but without significantly increasing the size of the connector. Additionally, there is a continued desire to reduce the manufacturing costs for these connectors.

SUMMARY OF THE INVENTION

In accordance with one aspect of the invention, an electrical connector is disclosed. The electrical connector includes a housing, at least two male contacts, and a shorting member. The at least two male contacts are mounted within the housing. The shorting member is connected to the housing. The shorting member includes a single loop section and an aperture. The single loop section is adapted to contact the at least two male contacts when the electrical connector is disengaged from a mating electrical connector. The single loop section is adapted to be spaced from the at least two male contacts when the electrical connector is engaged with the mating electrical connector. The at least two male contacts extend through the aperture.

In accordance with another aspect of the invention, an electrical connector assembly is disclosed. The electrical connector assembly includes a housing, at least one male contact, a terminal position assurance (TPA) member, and a shorting member. The at least one male contact is mounted within the housing. The TPA member is connected to the housing. The shorting member is attached to the TPA member. The shorting member includes a deflectable shorting bar. The deflectable shorting bar is configured to contact the at least one male contact.

In accordance with another aspect of the invention, a method of assembling an electrical connector assembly is disclosed. At least two male contacts are mounted within a housing. A shorting member is connected to the housing. The at least two male contacts are contacted with a single loop section of the shorting member. The at least two male contacts extend through an aperture of the shorting member.

In accordance with yet another aspect of the invention, a method of assembling an electrical connector assembly is disclosed. A terminal position assurance (TPA) member is provided. A shorting member is attached to the TPA member. At least one male contact is mounted within a housing. The TPA member and the attached shorting member are inserted into the housing. The at least one male contact is contacted with a deflectable shorting bar of the shorting member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
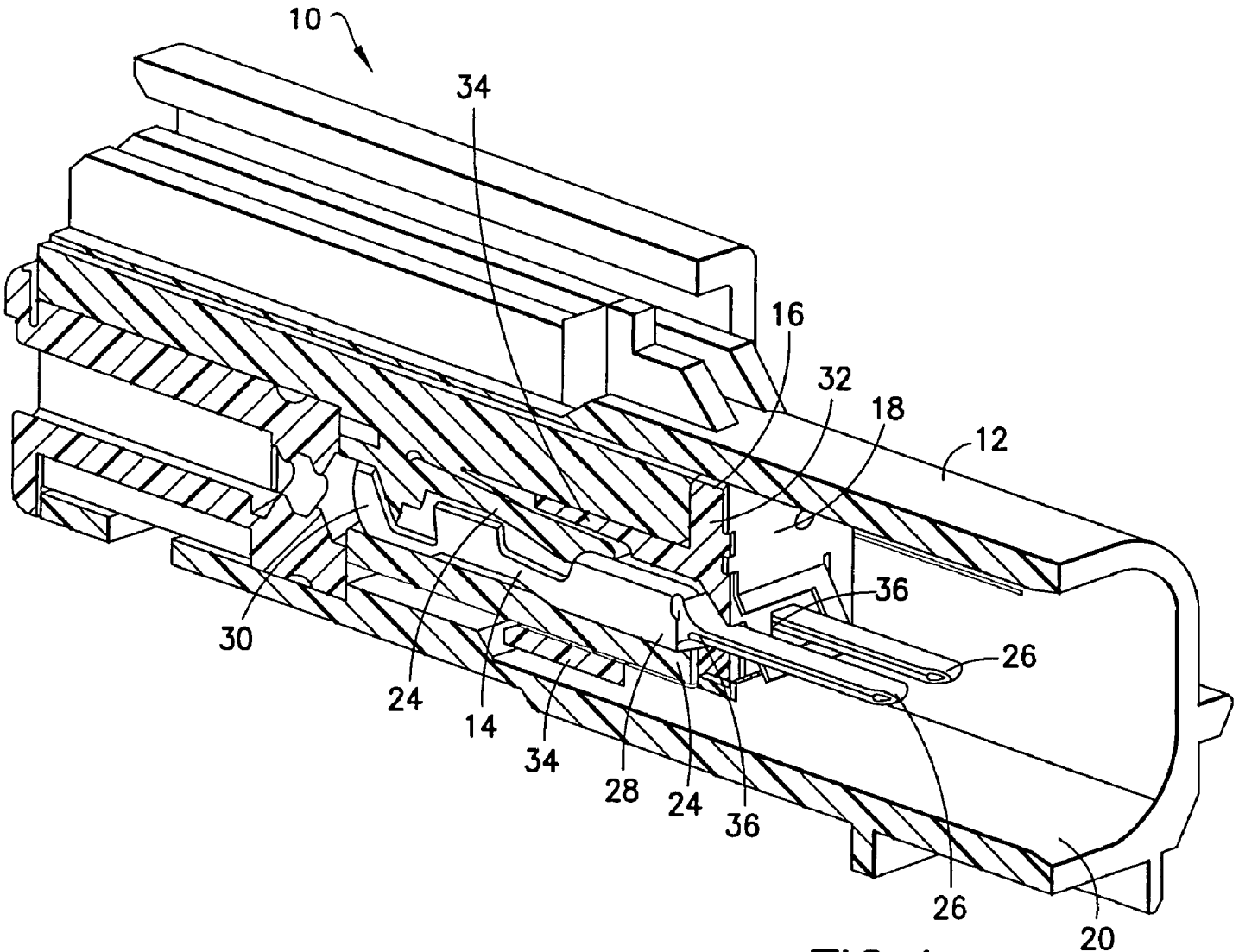
FIG. 1 is a perspective partial cross section view of an electrical connector comprising features of the invention.

Referring to FIG. 1, there is shown a perspective partial cross section view of an electrical connector 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

Figure 2:
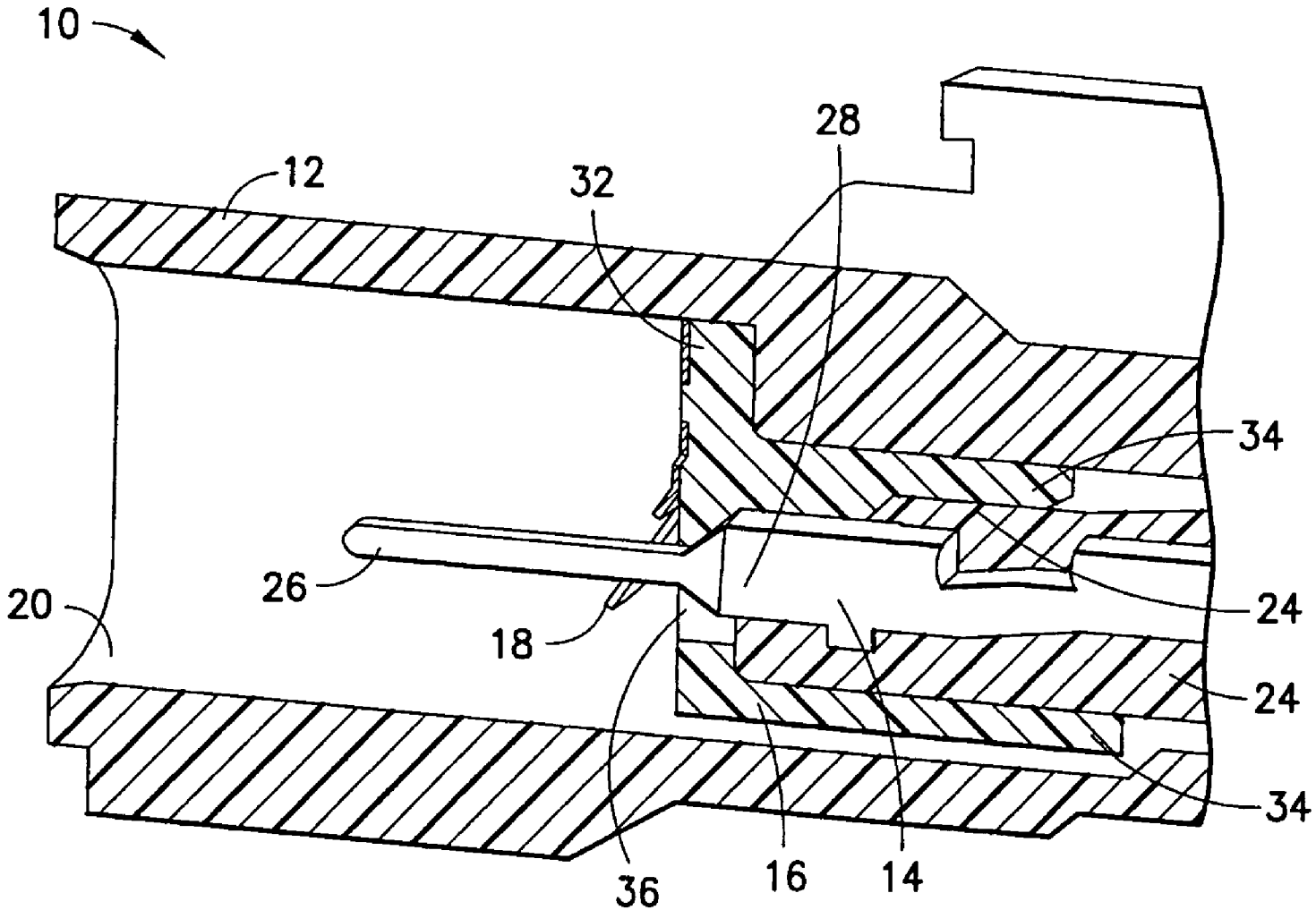
FIG. 2 is a perspective partial cross section view of the electrical connector shown in FIG. 1.

As shown in FIGS. 1 and 2, the electrical connector, or electrical connector assembly, 10 comprises a housing 12, two electrical terminals 14, a terminal position assurance (TPA) member 16, and a shorting member 18. The housing 12 comprises a receiving area 20 for receiving a front end of a housing of a second electrical connector 22 (shown in FIG. 4). The housing 12 also comprises deflectable latching arms 24. The latching arms 24 are configured to contact the electrical terminals 14. In this embodiment, the connector 10 is an automotive air bag safety system electrical connecter. However, in alternate embodiments, features of the invention could be used in any suitable type of electrical connector or electrical connector environment.

The electrical terminals 14 are mounted within the housing 12. When the terminals 14 are inserted into the housing 12, the latching arms 24 deflect to allow passage of the electrical terminals 14. When the electrical terminals 14 are fully inserted, the latching arms 24 return to their initial position and latch or contact surfaces of the electrical terminals 14 thereby securing the terminals 14 within the housing 12. Each of the electrical terminals 14 are generally configured to have a male contact or blade 26 extend from front ends 28 of the electrical terminals 14. Additionally, rear ends 30 of the electrical terminals 14 are adapted to each receive at least one electrical conductor (not shown). In the embodiment shown, two electrical terminals 14 are mounted within the housing 12. However, in alternate embodiments, more or less terminals 14 could be provided.

The TPA member 16 comprises a base section 32, projecting arms 34, and a plurality openings 36. The projecting arms 34 extend from the base section 32. The openings 36 extend through the base section 32 and are sized and shaped to allow the male contacts 26 to extend therethrough. When the TPA member 16 is inserted into the housing 12, openings within the housing 12 proximate the deflectable latching arms 24 receive the projecting arms 34. When the TPA member 16 is in place, the projecting arms 34 prevent the latching arms 24 from deflecting and thereby secure the electrical terminal 14 within the housing 12.

In the embodiment shown, the TPA member 16 comprises two projecting arms 34. However, in alternate embodiments, more or less projecting arms could be provided. It should also be noted that although the figures illustrate two openings 36 within the TPA member 16, any number of openings suitable to receive the male contact may be provided. Additionally, it should be noted that alternate embodiments may not have openings at all, such as wherein the TPA member is provided between rows or columns of male contacts for example.

Figure 3:
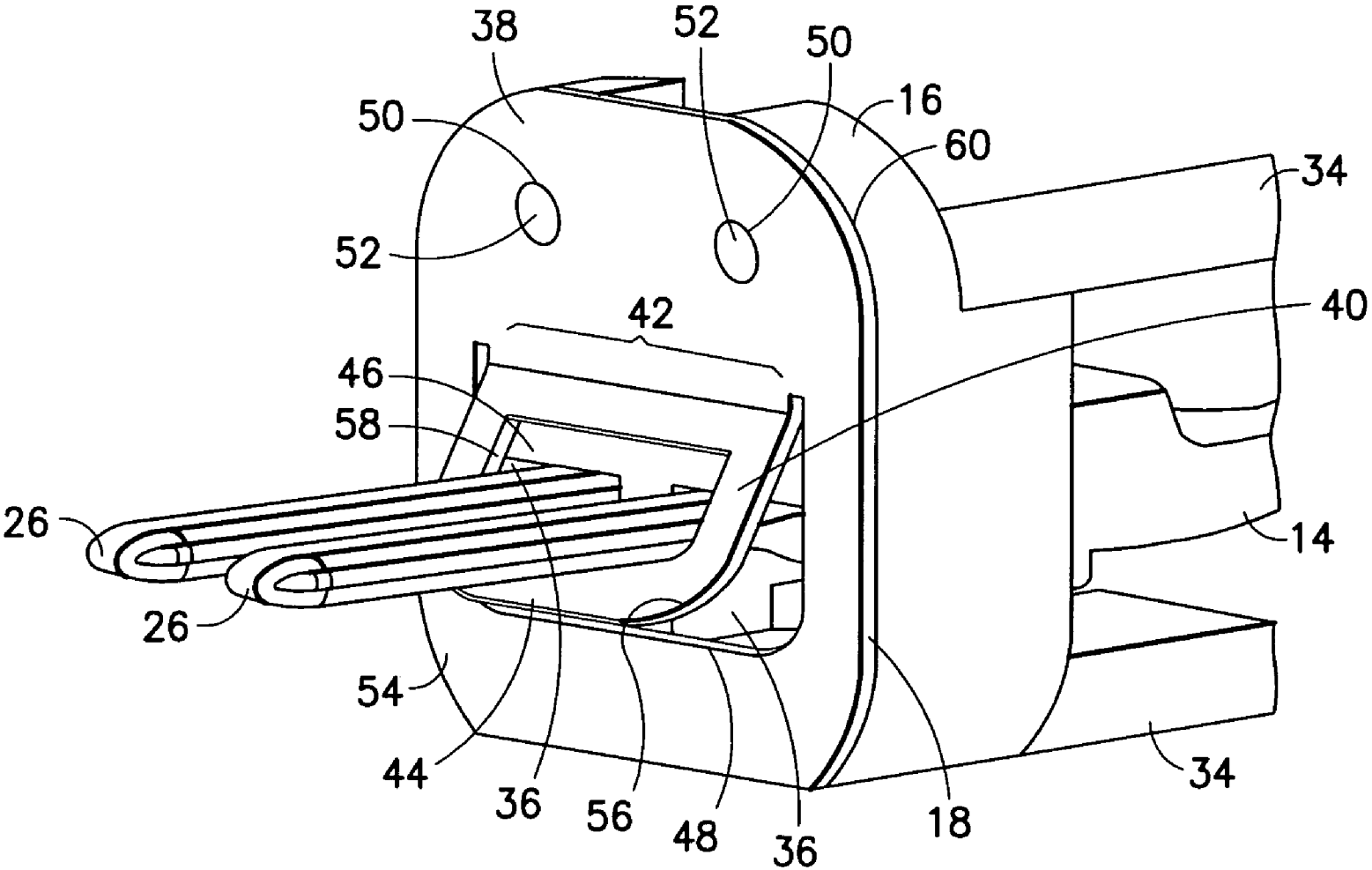
FIG. 3 is a perspective view of a terminal position assurance (TPA) member, shorting member, and male contacts used in the electrical connector shown in FIG. 1.

Referring now also to FIG. 3, the shorting member 18 comprises a base portion 38 and a deflectable portion 40. The deflectable portion 40 extends from a middle section 42 of the shorting member 18. The deflectable portion 40 comprises a single loop section, or shorting bar, 44 and an aperture 46. The single loop section 44 comprises a general horseshoe or "U" shape. The single loop section 44 forms an outer perimeter of the deflectable portion 40 at one (outer) edge 56. The single loop section 44 forms a portion of the aperture 46 at another (interior) edge 58, wherein the single loop section 44 surrounds a portion of the aperture 46. The aperture 46 is aligned with the openings 36 of the TPA member 16. The aperture 46 extends through the thickness of the deflectable portion 40 and is sized and shaped to allow the male contacts 26 to extend therethrough. It should be noted that although the figures illustrate the shorting member 18 as comprising one aperture 46, alternate embodiments may comprise more than one aperture. The shorting member 18 also comprises an opening 48. The opening 48 extends from the center section 42 and is also aligned with the openings 36 of the TPA member 16. When the deflectable portion 40 is positioned flush with the base portion 38, the opening 48 extends along the perimeter of the free ends of the deflectable portion 40. The shorting member 18 is preferably comprised of a one-piece member made of electrically conductive material such as sheet metal for example.

The shorting member 18 is attached to a front face 60 of the TPA member 16. The shorting member 18 comprises attachment holes 50 suitably sized and shaped to receive protrusions 52 extending from the TPA member 16. The attachment holes 50 are press-fitted over the protrusions 52 to secure the shorting member 18 to the TPA member 16. However, it should be noted that the attachment holes 50 and protrusions 52 are not required, as any suitable method of attaching the shorting member 18 to the TPA member 16 may be provided, such as riveting or bonding for example.

The attachment of the shorting member 18 to the TPA member 16 is preferably performed before the TPA member 16 is inserted into the housing 12. After the shorting member 18 is attached to the TPA member, the shorting member 18 and the TPA member 16 are inserted into the housing. The shorting member 18 and the TPA member 16 are inserted into the housing through the open end of the receiving area 20 and moved towards the terminals 14 until the openings within the housing 12 proximate the deflectable latching arms 24 receive the projecting arms 34 of the TPA member 16.

The deflectable portion 40 is deflectable between a first position and a second position. The deflectable portion 40 is aligned at an angle with respect to the base portion 38 when the deflectable portion 40 is in the first position (shown in FIG. 3). Both of the male contacts 26 extend through the single aperture 46. As the deflectable portion 40 deflects away from the TPA member 16, an inner edge 58 of the aperture 46 (at the single loop section 44) contacts the male contacts or blades 26. When the deflectable portion 40 is in the second position (shown in FIG. 4) the deflectable portion 40 is aligned substantially flush with respect to the base portion 38.

Figure 4:
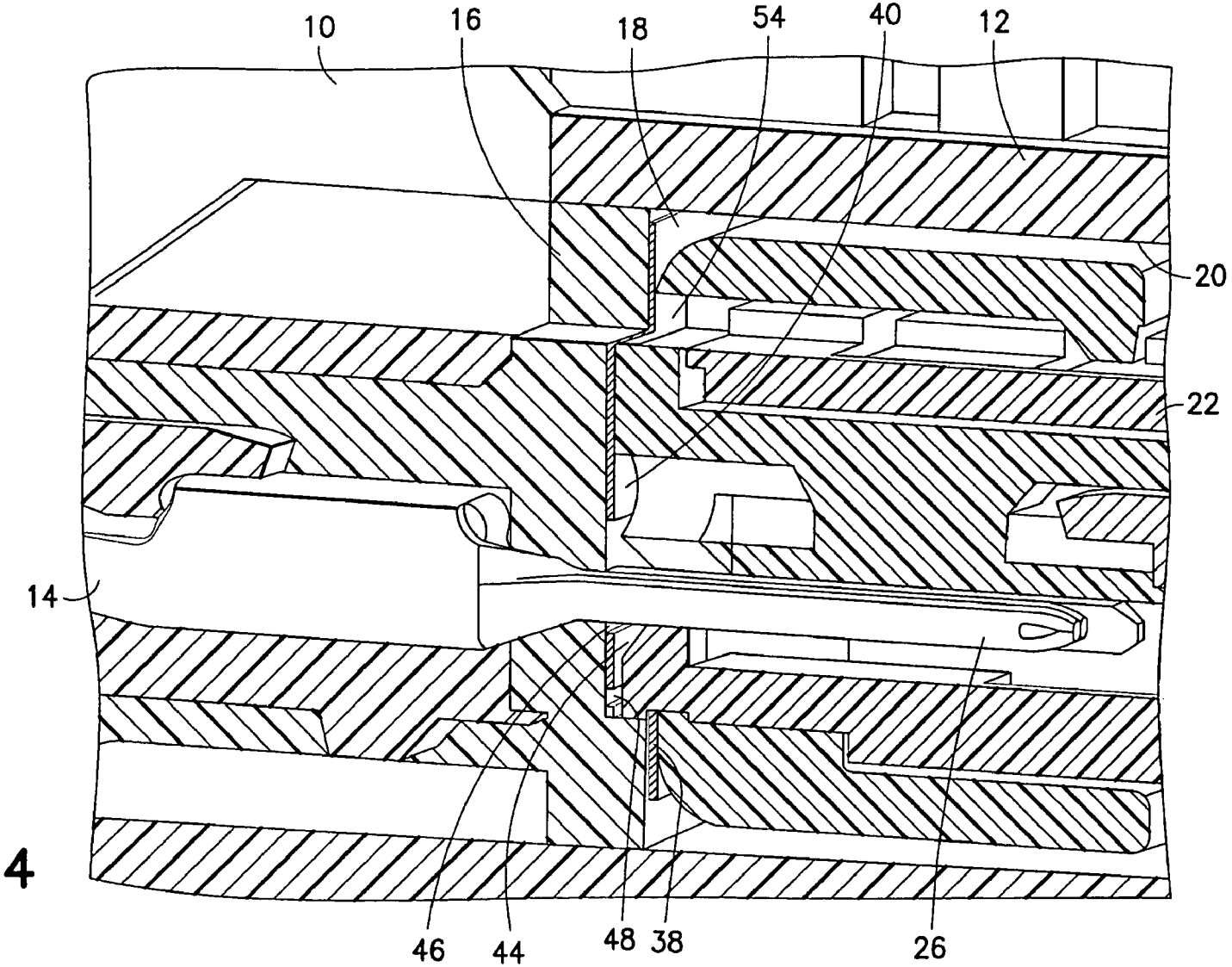
FIG. 4 is a perspective partial cross section view of the electrical connector shown in FIG. 1 engaged with a mating electrical connector.

The deflectable portion 40 is moved from the first position to the second position when the electrical connector or male connector 10 is engaged with the second connector or mating female connector 22 (as illustrated in FIG. 4). As the female connector 22 is inserted into the housing 12, towards a mating face 54 of the base portion 38, the single loop section 44 (and the deflectable portion 40) is deflected away from, or pushed off, the male contacts 26. Thus, the electrical short circuit of the pair of male contacts 26 by the single loop section 44 is stopped. When the female connector 22 is fully engaged with the male connector 10, the deflectable portion 40 is moved back to the opening 48 (and the single loop section 44 can recess into the opening 48) as the single loop section 44 (and deflectable portion 40) is sandwiched between the two connectors 10, 22. In this position, the deflectable portion 40 forms a portion of the mating face 54 and contacts the female connector 22. Thus, when the electrical connector 10 is mated with the second electrical connector 22, the shorting member 18 only forms an overall thickness (wherein the thickness is the direction normal to the mating face 54) equal to the thickness of the sheet material forming the shorting member 18.

When the female connector 22 is removed, or disengaged, from the male connector 10, the deflectable portion 40 returns to the first position (or default position). Therefore, as the female connector 22 no longer forces the deflectable portion 40 to be flush with the base portion 38, the resilient shorting bar 44 engages the terminals 14 at the male contacts 26.

The disclosed shorting member 18 provides many advantages over conventional configurations. The shorting member 18 may be integrally formed as a one-piece member which allows for simplified manufacturing and reduced manufacturing costs. The shorting member 18 is also easy to install and, therefore, reduces assembly times and costs. Additionally, the compact size allows the shorting member 18 to be compatible with many different connector configurations (as the small overall thickness of the shorting member can be sandwiched between many different existing male contact lengths). Furthermore, the disclosed shorting member 18 provides a robust configuration which increases the reliability and life cycle of the connector.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

a housing;

at least two male contacts connected to the housing; and a shorting member connected to the housing, wherein the shorting member comprises a single loop section and an aperture, wherein the single loop section is deflectable, wherein the single loop section is adapted to contact the at least two male contacts when the electrical connector is disengaged from a mating electrical connector, wherein the single loop section is adapted to be spaced from the at least two male contacts when the electrical connector is engaged with the mating electrical connector, and wherein the at least two male contacts extend through the aperture.

2. The electrical connector of claim 1 further comprising a terminal position assurance (TPA) member, wherein the TPA member is connected to the housing, and wherein the shorting member is directly attached to the TPA member.

3. The electrical connector of claim 2 wherein the TPA member comprises an opening, wherein one of the at least two male contacts extends through the opening, and wherein the aperture is substantially aligned with the opening.

4. The electrical connector of claim 1 wherein the single loop section extends from a middle section of the shorting member.

5. The electrical connector of claim 1 wherein the single loop section has a general "U" shape.

6. The electrical connector of claim 1 wherein the shorting member further comprises a mating face, wherein the mating face is configured to contact the mating electrical connector, and wherein the single loop section is configured to form a portion of the mating face when the electrical connector is engaged with the mating electrical connector.

7. The electrical connector of claim 1 wherein the single loop section is configured to be flush with the shorting member when the electrical connector is engaged with the mating electrical connector.

8. An electrical connector comprising:

a housing;

at least two male contacts connected to the housing; and a shorting member connected to the housing, wherein the shorting member comprises a single loop section and an aperture, wherein the single loop section is adapted to contact the at least two male contacts when the electrical connector is disengaged from a mating electrical connector, wherein the single loop section is adapted to be spaced from the at least two male contacts when the electrical connector is engaged with the mating electrical connector, wherein the at least two male contacts extend through the aperture, and wherein the single loop section surrounds a portion of the aperture.

9. An electrical connector assembly comprising:

a housing comprising a deflectable latching arm;

at least one male contact connected to the housing;

a terminal position assurance (TPA) member connected to the housing, wherein the TPA member comprises a projecting arm, and wherein the projecting arm is configured to contact the latching arm of the housing; and a shorting member attached to the TPA member, wherein the shorting member comprises a deflectable shorting bar, and wherein the deflectable shorting bar is configured to contact the at least one male contact.

10. The electrical connector assembly of claim 9 wherein the shorting member comprises an aperture, wherein the deflectable shorting bar surrounds a portion of the aperture, and wherein the at least one male contact extends through the aperture.

11. The electrical connector assembly of claim 10 wherein the TPA member further comprises an opening, wherein the at least one male contact extends through the opening, and wherein the aperture is substantially aligned with the opening.

12. The electrical connector assembly of claim 10 wherein a first one and a second one of the at least one male contact extend through the aperture.

13. The electrical connector assembly of claim 12 wherein the shorting bar is configured to contact the first one and the second one of the at least one male contact.

14. The electrical connector assembly of claim 9 wherein the shorting bar comprises a general "U" shape.

15. The electrical connector assembly of claim 9 wherein the deflectable shorting bar is configured to be deflectable between a first position and a second position, wherein the deflectable shorting bar is configured to be aligned at an angle to the shorting member in the first position, and wherein the deflectable shorting bar is configured to be aligned substantially flush with the shorting member in the second position.

16. An electrical connector assembly comprising:

a housing;

at least one male contact connected to the housing;

a terminal position assurance (TPA) member connected to the housing; and a shorting member attached to the TPA member, wherein the shorting member comprises a deflectable shorting bar, wherein the deflectable shorting bar is configured to contact the at least one male contact, and wherein the shorting bar extends from a middle section of the shorting member.

17. A method of assembling an electrical connector assembly comprising:

mounting at least two male contacts within a housing;

connecting a shorting member to the housing, wherein the connecting of the shorting member to the housing comprises attaching the shorting member to a terminal position assurance (TPA) member and mounting the TPA member to the housing; and contacting the at least two male contacts with a single loop section of the shorting member, wherein the at least two male contacts extend through an aperture of the shorting member.

18. A method of assembling an electrical connector assembly comprising:

providing a terminal position assurance (TPA) member, wherein the TPA member comprises a projecting arm;

attaching a shorting member to the TPA member;

mounting at least one male contact within a housing, wherein the housing comprises a deflectable latching arm;

inserting the TPA member and the attached shorting member into the housing, wherein the projecting arm is configured to contact the latching arm of the housing; and contacting the at least one male contact with a deflectable shorting bar of the shorting member.

19. The method of claim 18 wherein the deflectable shorting member deflects in a direction away from the TPA member.

* * * * *